US011117009B2

(12) United States Patent
Parker et al.

(10) Patent No.: US 11,117,009 B2
(45) Date of Patent: Sep. 14, 2021

(54) CONTINUOUS LOOP EXERCISE APPARATUS AND METHOD

(71) Applicant: Pivot Product Development LLC, Naperville, IL (US)

(72) Inventors: Donald Parker, Okoyama (JP); Daniel Rennecker, Naperville, IL (US); Steven Schennum, Plainfield, IL (US); Zachary Burchman, Chicago, IL (US); Thomas McKeon, Wheaton, IL (US)

( * ) Notice: Subject to any disclaimer, the term of this patent is extended or adjusted under 35 U.S.C. 154(b) by 0 days.

(21) Appl. No.: 15/733,819

(22) PCT Filed: Jun. 1, 2019

(86) PCT No.: PCT/US2019/035089
§ 371 (c)(1),
(2) Date: Nov. 30, 2020

(87) PCT Pub. No.: WO2019/236431
PCT Pub. Date: Dec. 12, 2019

(65) Prior Publication Data

US 2021/0213320 A1 Jul. 15, 2021

Related U.S. Application Data

(60) Provisional application No. 62/680,065, filed on Jun. 4, 2018.

(51) Int. Cl.
*A63B 21/02* (2006.01)
*A63B 21/045* (2006.01)
*A63B 1/00* (2006.01)

(52) U.S. Cl.
CPC ..... *A63B 1/00* (2013.01); *A63B 21/02* (2013.01); *A63B 21/045* (2013.01); *A63B 2208/0204* (2013.01); *A63B 2208/0228* (2013.01); *A63B 2208/0252* (2013.01); *A63B 2210/02* (2013.01)

(58) Field of Classification Search
CPC ..... A63B 21/04; A63B 21/055; A63B 21/16; A63B 1/00; A63B 2208/0228; A63B 2210/02; A63B 21/045–0455; A63B 23/00; A63B 23/02–04; A63B 2023/003–006; A63B 21/02; A63B 2208/0204; A63B 2208/0252
See application file for complete search history.

(56) References Cited

U.S. PATENT DOCUMENTS

| | | | |
|---|---|---|---|
| 2,223,309 | A | 11/1940 | Swanson |
| 3,640,529 | A | 2/1972 | Kane |
| 3,985,354 | A | 10/1976 | Schulkin |
| D322,827 | S | 12/1991 | Bennstrom et al. |
| D343,882 | S | 2/1994 | Bennstrom et al. |

(Continued)

*Primary Examiner* — Andrew S Lo
(74) *Attorney, Agent, or Firm* — Christopher J. Scott

(57) ABSTRACT

A versatile, multi-purpose and portable continuous loop exercise apparatus designed so as to enable users thereof to exercise multiple body parts through resistive training. The unique continuously looped structure enables users to perform various exercises. The continuous loop exercise apparatus may be utilized in combination with the floor, on the chair, or can be placed on a table or countertop without the requirement to reconfigure or reassemble the product. The one-piece curved design allows users with different body builds to perform the same exercises appropriately by changing the holding user-to-apparatus contact positions rather than by adjusting the dimensions of the equipment.

17 Claims, 12 Drawing Sheets

(56) References Cited

U.S. PATENT DOCUMENTS

| | | | |
|---|---|---|---|
| 5,399,138 | A | 3/1995 | Jones |
| 6,120,424 | A | 9/2000 | Arline |
| 6,616,580 | B1 | 9/2003 | Chen |
| 6,966,871 | B2 | 11/2005 | Parmater |
| 8,790,227 | B2 | 7/2014 | Meister et al. |
| 2004/0110610 | A1 | 6/2004 | Chen et al. |

Position B

Position C

Position D

CONTINUOUS LOOP EXERCISE APPARATUS AND METHOD

PRIOR HISTORY

This application is a US national stage entry application from International Patent Application No. PCT/US2019/035089 filed in the United States Patent and Trademark Office (USPTO) as International Receiving Office on 1 Jun. 2019, which International Patent Application claims priority to U.S. Provisional Patent Application No. 62/680,065 filed in the USPTO on 4 Jun. 2018, the specification and drawings of which applications are incorporated herein by reference.

BACKGROUND OF THE INVENTION

Field of the Invention

The present invention is a continuous loop exercise apparatus designed so as to enable users thereof to exercise multiple body parts through resistive training.

Brief Description of the Prior Art

With the advancement of modern technological gadgets, the increasing dependency of humans on these technological gadgets and services received by them is causing adverse impact on certain aspects of human lifestyle such as physical activity. Physical training such as resistive training and cardiovascular training is required for overall physical fitness. In the current scenario, considering the paucity of time and space constraint, it is difficult to visit or maintain a gym at home. Therefore, there is a need for devices that are compact, portable, easy to assemble and disassemble while allowing the flexibility to execute various types of exercises.

Various exercise devices formed from rods and bars are available which could be portable but lack the flexibility in use. The device disclosed in U.S. Pat. No. 5,399,138, for example, is an abduction exercise device which includes a helical spring serving as a pivot to permit the arms to move away from each other and is also configured to grip the legs of the human when being used to exercise the legs. The devices disclosed in US Design patent No. D343,882 and US Design patent No. D322,827 is an ornamental design of exerciser that include a spring means.

The device disclosed in U.S. Pat. No. 8,790,227 is an exercise apparatus that includes a U-bar, the ends of which are pivotally coupled to two Lbars by rotatable hinge assemblies containing a torsion spring. The device disclosed in U.S. Pat. No. 6,966,871 is an exercise device wherein the frame includes a pair of movable locks and the locks can be released and engaged by articulating the lock tab. A pair of springs are included in the structure of the bar and the bar post does not extend through the spring thus holding in the locked position.

Other prior art of note include U.S. Pat. No. 2,223,309 ('309 Patent), issued to Swanson; U.S. Pat. No. 3,640,529 ('529 Patent), issued to Kane; U.S. Pat. No. 3,985,354 ('354 Patent) issued to Schulkin; U.S. Pat. No. 6,120,424 ('424 Patent) issued to Arline; U.S. Pat. No. 6,616,580 ('580 Patent), issued to Chen; and US Patent Application Publication No. 2004/0110610 ('610 Publication) authored by Chen et al. The '580 Patent, in particular, describes a collapsible combination waist and leg exerciser comprising a base, two elastic frames, and two connected handles.

In use, the user may stand on base with hands grasped on the handles and bend waist forward facing elastic frames in order to exercise up and down repeatedly. The user may also sit on a chair with the chair's legs pressed on base by the weight of the user. The user's feet are urged against the top of handles for exercising up and down repeatedly. The user may lay back with feet urged against the top of handles in a continuous up and down movement. This can train or develop the parts of body such as chest, arms, waist, legs, and buttock effectively in a small environment.

The exercise devices disclosed in the prior-art have employed the use of both in-line coil spring and torsion springs thus providing either only a pivotal movement or as a fixed construction. Also, they can be used only for certain specified exercises. Some of the prior-art devices include the use of heavy components such weight plates, which are heavy to move.

To overcome the aforementioned disadvantages, the present invention incorporates a series of inline resistance elements and rigid intervening structures assembled so as to form a continuous loop of elements. This enables flexion or extension of the apparatus for imparting resistive training to different body parts of the user. Given the unique continuously looped design of the present invention, the exercise apparatus may be utilized in combination with the floor, on the chair, or can be placed on a table or countertop without the requirement to reconfigure or reassemble the product.

OBJECTS OF THE INVENTION

The principle object of the present invention is to provide a versatile, multipurpose and portable continuous loop exercise apparatus.

Another object of the invention is to provide a continuous loop exercise apparatus for the purpose of imparting resistive training.

Still another object of the invention is to provide a versatile, multi-purpose and portable continuous loop exercise apparatus which can be used for exercising on the floor, on the chair, or can be placed on a table or countertop as well, without the requirement of reconfiguring or reassembling.

A further object of the invention is to provide a versatile, multi-purpose and portable continuous loop exercise apparatus wherein, the low impact design of the apparatus minimizes wear on joints.

SUMMARY OF THE INVENTION

The present invention generally concerns a continuous loop exercise apparatus designed so as to enable users thereof to exercise multiple body parts through resistive training. The present invention incorporates a series of inline resistance elements and rigid intervening structures assembled so as to form a continuous loop of elements. The series of inline resistance elements are particularly located so as to enable flexion or extension of the apparatus for imparting resistive training to differing body parts of the user. The unique continuously looped design of the present invention is such that the exercise apparatus may be utilized in combination with floor, on the chair, or can be placed on a table or countertop as support structures without the requirement to reconfigure or reassemble the apparatus.

The continuous loop design provides extension type resistance elements that are in-line with rigid body members thereby eliminating elements that protrude from the compact dynamic volumetric space. Various aspects of the apparatus and its looped characteristics allow the exercise apparatus to be used for a wide variety of exercises and the one-piece curved design allows users with different body builds to perform the same exercises appropriately by changing the user-to-apparatus contact positions rather than by adjusting the dimensions of the equipment, as is the case with most of the prior-art exercise apparatus. When higher or lower resistance is desired, it is contemplated that the resistance elements may be readily swapped out for resistance elements of differing restorative force, but remain in-line with the rigid body members.

BRIEF DESCRIPTION OF THE DRAWINGS

The particular features and advantages of the invention as well as other objects of the invention will become apparent from the following description taken in connection with the accompanying drawings in which.

While the drawings submitted in support of these specifications depict resistance elements, the invention could conceivably be practiced with other types of resistance elements such as springs, elastic members, bands, and the like.

DETAILED DESCRIPTION OF THE PREFERRED EMBODIMENT

Various embodiments will now be described to provide an overall understanding of the principles of the structure, function, manufacture, and use of the apparatus and methods disclosed herein. One or more examples of these embodiments are illustrated in the accompanying drawings. Those of ordinary skill in the art will understand that features described or illustrated in connection with one example embodiment can be combined with the features of other example embodiments without generalization from the present disclosure.

The accompanying drawings, which are included to provide a further understanding of the invention and are incorporated in and constitute a part of this specification, illustrate the embodiments of the present invention, and together with the description serve to explain the principles of the invention.

The present invention is a versatile, multi-purpose and portable continuous loop exercise apparatus 10 that includes various components that are adjustable to support wide variety of exercises in a single apparatus.

Figure 1A:
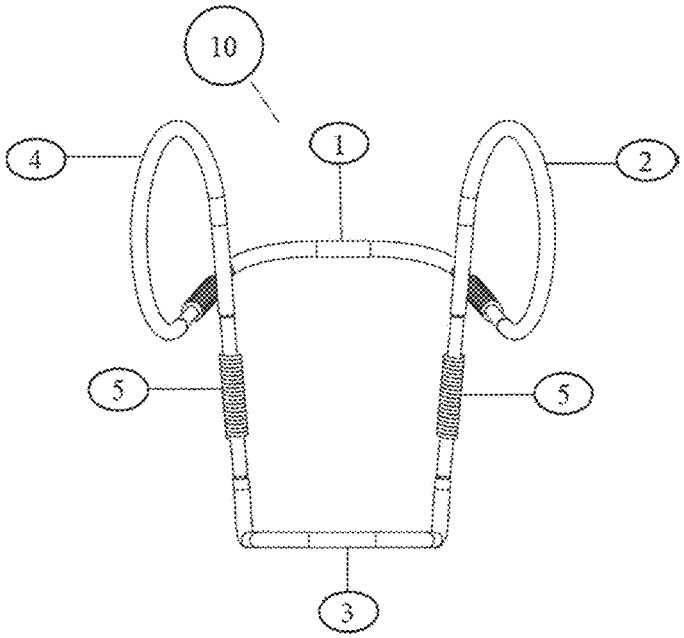
FIG. 1*a* is a front view of a versatile continuous loop exercise apparatus 10 in accordance with the present invention.
Figure 1B:
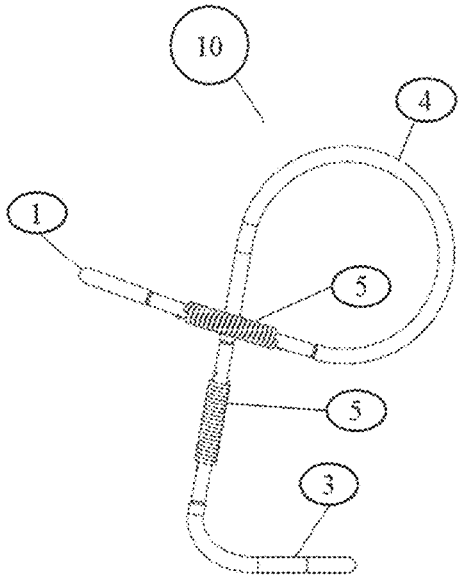
FIG. 1*b* is a side view of a continuous loop exercise apparatus 10 in accordance with the present invention.
Figure 1C:
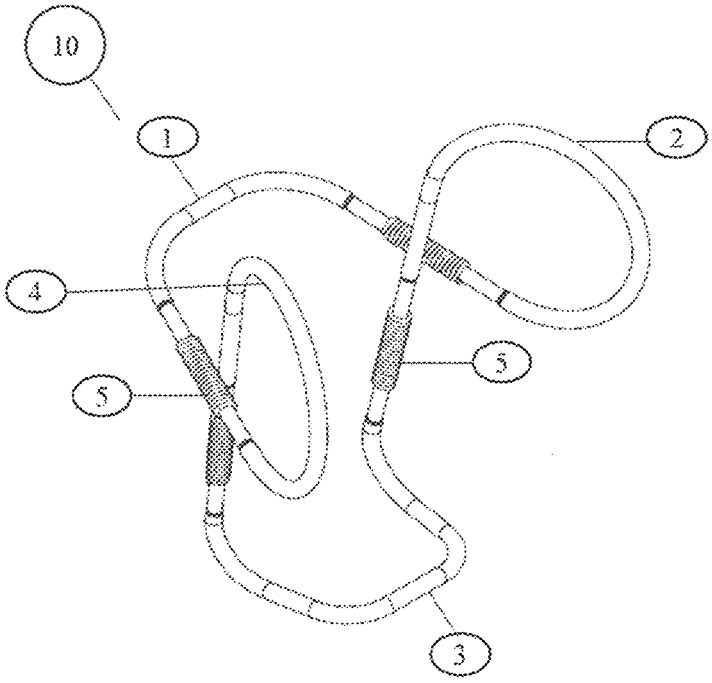
FIG. 1*c* is an isometric view of a continuous loop exercise apparatus 10 in accordance with the present invention.

The present invention is a continuous loop exercise apparatus 10 as shown in FIG. 1*a*, FIG. 1*b*, and FIG. 1*c*, comprising an upper member 1, a right member 2, a lower member 3, a left member 4 and a plurality of resistance elements 5, wherein each of the said members 1, 2, 3 and 4, and resistance elements 5 further comprise a first end 1*a*, 2*a*, 3*a*, 4*a* and 5*a*, and a second end 1*b*, 2*b*, 3*b*, 4*b* and 5*b*, having mateable connections 1*c*, 2*c*, 3*c*, 4*c* and 5*c* respectively.

The said mateable connections 1*c*, 2*c*, 3*c*, and 4*c*, of the said upper member 1, said right member 2, said lower member 3, and said left member 4 respectively according to an embodiment of the present invention, are male spring-loaded connections. The said mateable connection 5*c*, of the said resistance elements 5 according to an embodiment of the present invention, is a female hole.

The continuous loop exercise apparatus 10 as shown in FIG. 1*a*, FIG. 1*b*, and FIG. 1*c*, includes an upper member 1 that provides support for the users to hold the exercise apparatus 10. The continuous loop exercise apparatus 10 also includes a right member 2 and a left member 4 that form a loop structure which will support users to grip the continuous loop exercise apparatus 10 while performing exercises.

The continuous loop exercise apparatus 10 further includes a lower member 3 which acts as a support structure for resting the continuous loop exercise apparatus 10. Further, the continuous loop exercise apparatus 10 includes resistance elements 5 which are responsible for the flexion or extension of the continuous loop exercise apparatus 10 when all the components are assembled together.

According to an embodiment of the present invention, the mateable connections 1*c*, 2*c*, 3*c*, and 4*c*, of each of the said members 1, 2, 3 and 4, respectively can be connected with the mateable connection 5*c* of the resistance elements 5, through snap-fit, screw-fitted, or any known means of attachment in the prior art. According to another embodiment of the present invention, the said mateable connections of each of the said members can be connected through welding or any other techniques known to a person skilled in the art.

The present invention is a uniquely designed continuous loop exercise apparatus 10 wherein, which in the assembled construction as shown in FIG. 1*a*, FIG. 1*b*, and FIG. 1*c*, provides flexibility to perform various exercises without the requirement of any additional components or devices. The uniquely designed continuous loop exercise apparatus 10 can be placed in various positions on the floor, on the chair, or can be placed on a table or a countertop to perform various exercises. The simple assembling process enables the continuous loop exercise apparatus 10 to be quickly installed and carry out exercises to tone, tighten and strengthen the entire body.

Figure 2:
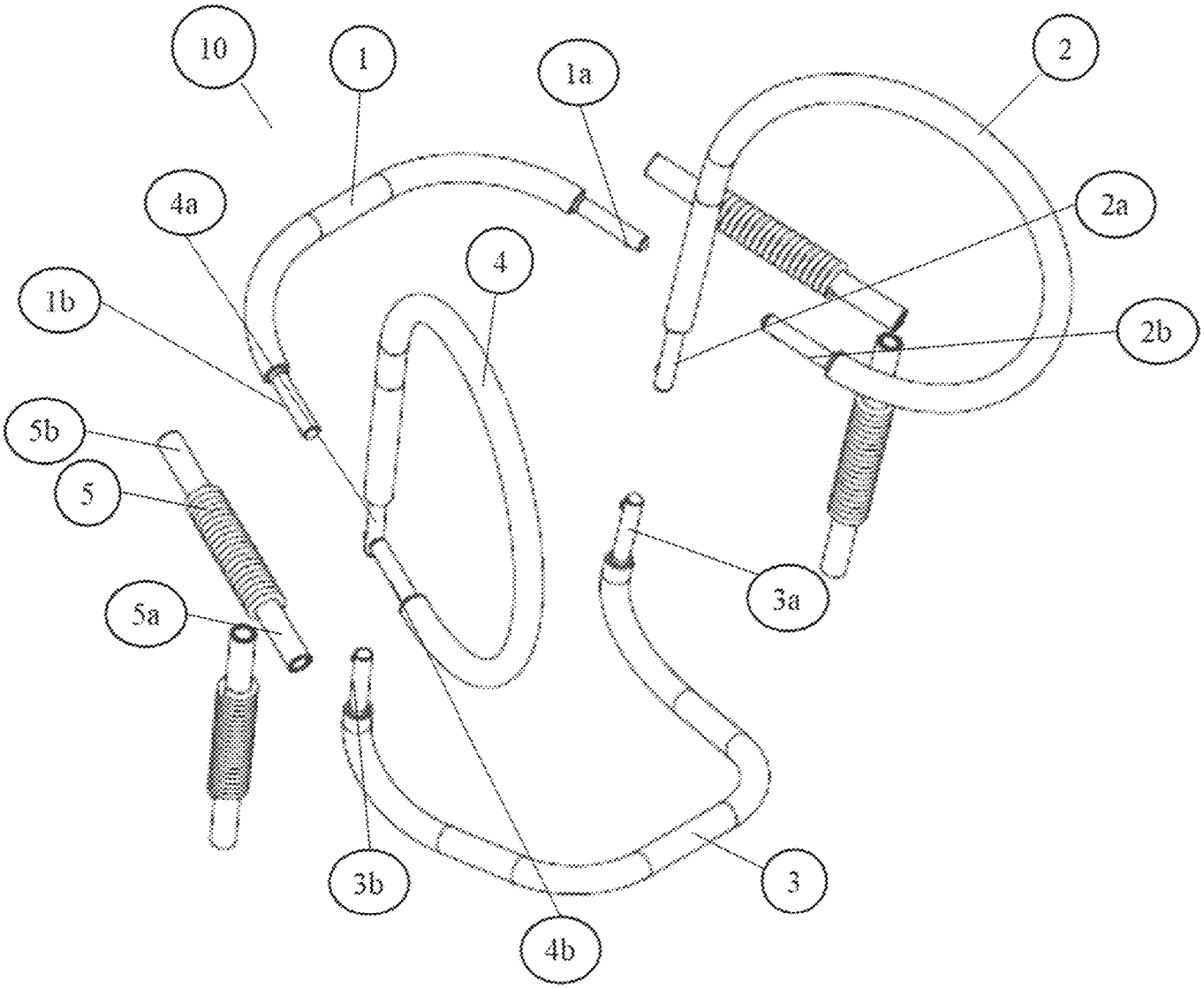
FIG. 2 is an exploded isometric view of a continuous loop exercise apparatus 10 in accordance with the present invention.

The assembling of the continuous loop exercise apparatus 10 will be disclosed in detail. As shown in FIG. 2, firstly, the lower member 3 is placed on the floor. One of the resistance elements 5 with a first end 5*a* is placed over a first end of the lower member 3*a*. Similarly, another resistance element 5 with a first end 5*a* is placed over a second end of the lower member 3*b*. Further, the left member 4 with a left member 4*a* is placed over the second end 5*b* of the said resistance element 5. Similarly, the right member 2 with a right member 2*a* is placed over the second end 5*b* of the said resistance element 5. The apparatus is positioned to rest the right member 2 and the left member 4 on the floor.

Further, another resistance element 5 with a first end 5*a* is placed over a first end of the upper member 1*a* and yet another resistance element 5 with a first end 5*a* is placed over the second end of the upper member 1*b*. The assembled component 1 along with the two resistance elements 5 with their second ends 5*b*, are placed over a second end of the right member 2*b* and a second end of the left member 4*b* respectively. The continuous loop exercise apparatus 10 is then brought back to the original position with the lower member 3 resting on the floor. Various assembly methods are known and can be used for assembling the present invention without limitation to the assembling approaches discussed here.

Figure 3A:
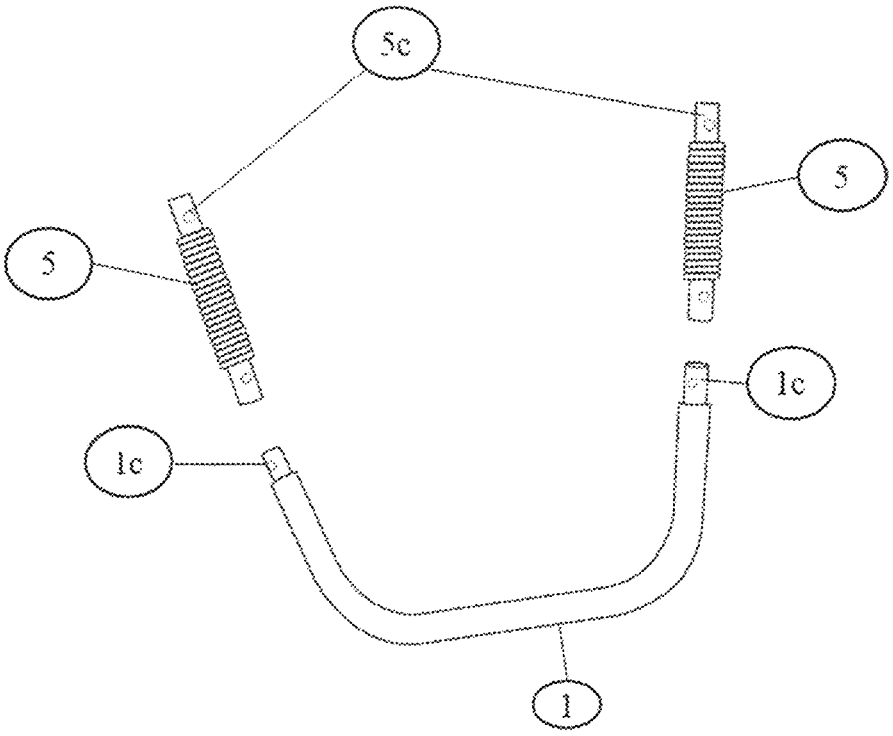
FIG. 3*a* is front view of a continuous loop exercise apparatus 10 showing the assembly of female hole portion of the resistance elements and male spring-loaded connections of upper member in accordance with the present invention.
Figure 3B:
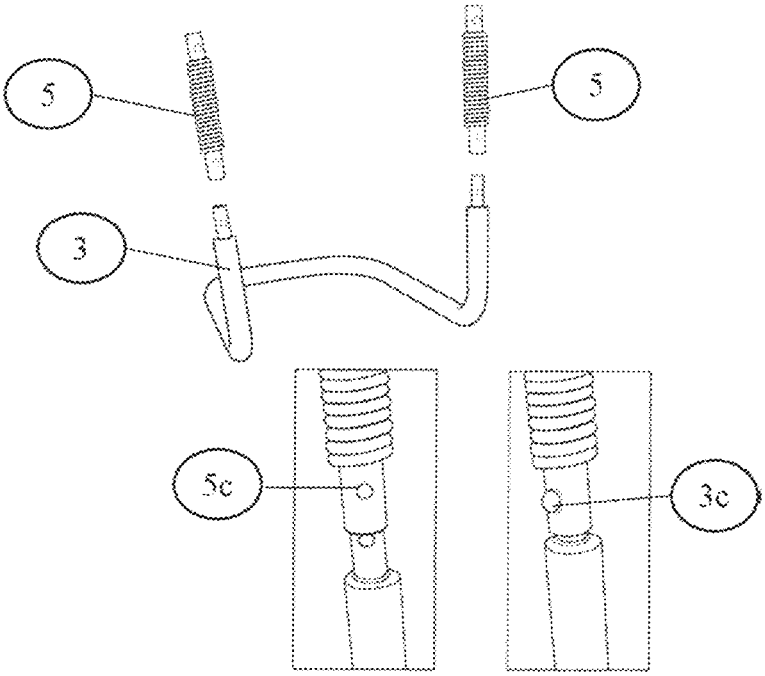
FIG. 3*b* is an enlarged view of a continuous loop exercise apparatus 10 showing the assembly of female hole portion of the resistance elements and male spring-loaded 10 connections of the lower member 3 in accordance with the present invention.
Figure 3C:
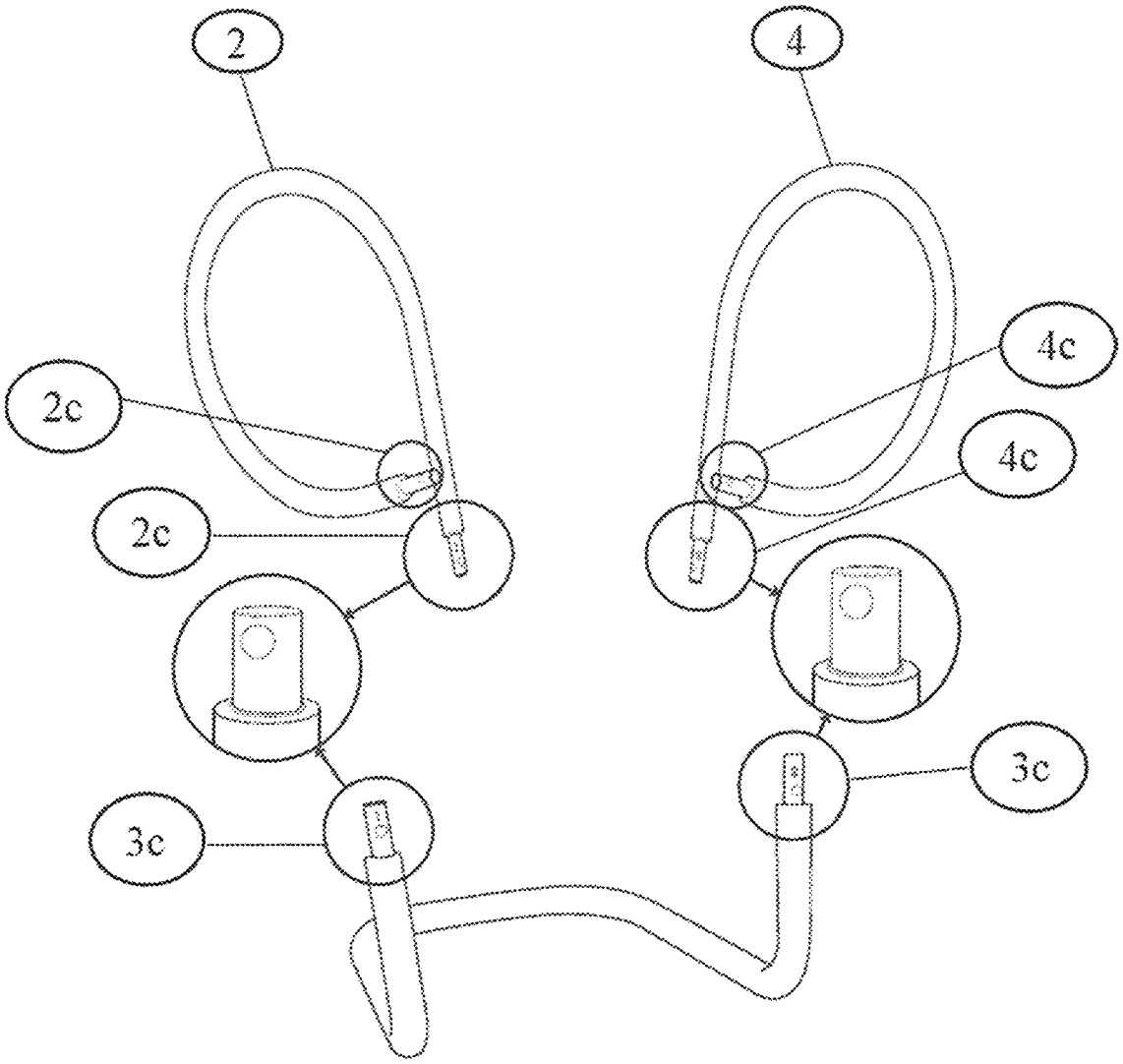
FIG. 3*c* is an enlarged view of a continuous loop exercise apparatus 10 showing the details of male spring-loaded connection 2*c* of right member 2 and male spring-loaded connection 4*c* of left member 4, similarly, the details of male spring-loaded connection 3*c* of the lower member 3 is shown in accordance with the present invention.

Further details of assembling the continuous loop exercise apparatus 10 is as shown in FIG. 3*a*, FIG. 3*b*, and FIG. 3*c*, wherein the upper member 1 includes a first male spring-loaded connection 1*c* on the first end 1*a* and a second male spring-loaded connection 1*c* on the second end 1*b*. The right member 2 includes a first male spring-loaded connection 2*c* on the first end 2*a* and a second male spring-loaded connection 2*c* on the second end 2*b*. The lower member 3 includes a first male spring-loaded connection 3*c* on the first end 3*a* and a second male spring-loaded connection 3*c* on the second end 3*b*.

The left member 4 includes a first male spring-loaded connection 4*c* on the first end 4*a* and a second male spring-loaded connection 4*c* on the second end 4*b*. Further each of the said resistance elements 5 includes a female hole 5*c* on first end 5*a* and another female hole 5*c* on second end 5*b*. As described, all the male spring-loaded connections are of the same construction and all the female holes are of the same size and shape to mate with the male connections.

In accordance with the assembly as disclosed in the FIG. 2, as the components are placed over the resistance elements 5, the male spring-loaded connections 1*c*, 2*c*, 3*c*, and 4*c*, mate with the female holes 5*c* of the resistance element 5 respectively, to provide a rigid locking structure. Once all the components are placed and mated with each other, the continuous loop exercise apparatus 10 forms a unitary structure that would allow the user to perform various exercises by placing the continuous loop exercise apparatus 10 on the floor or on the chair or on the table or on the countertop.

Figure 4A:
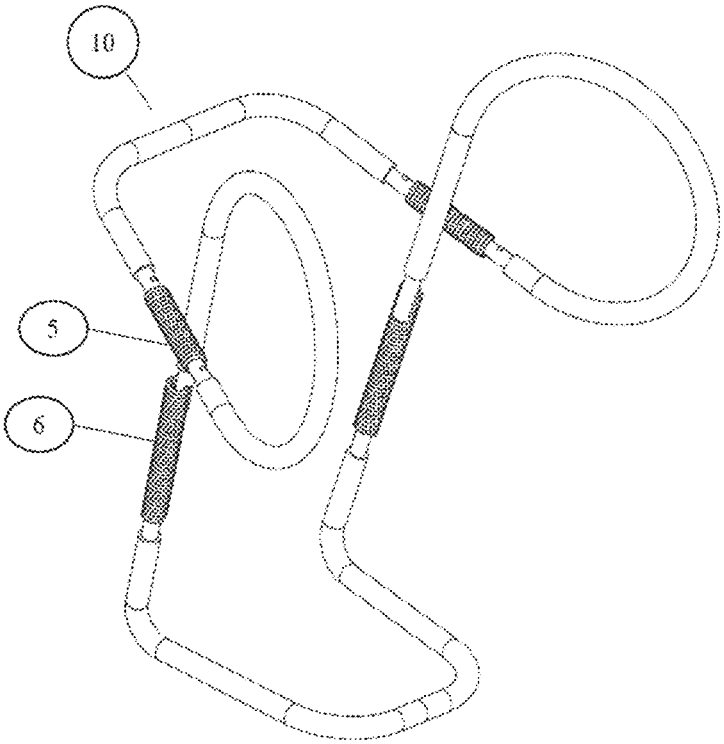
FIG. 4*a* is an isometric view of a continuous loop exercise apparatus 10 showing the resistance elements of varying sizes, according to another embodiment of the present invention.
Figure 4B:
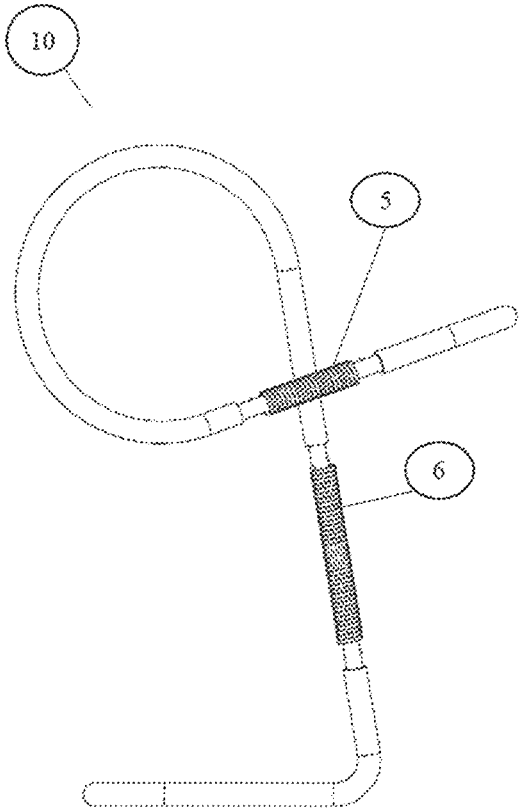
FIG. 4*b* is a side view of a continuous loop exercise apparatus 10 showing the resistance elements of varying sizes, according to another embodiment of the present invention.

According to another embodiment, while the present invention depicts four resistance elements 5 of equal length, the alternative embodiments could include sets of resistance elements of differing lengths. As shown in FIG. 4*a*, and FIG. 4*b*, the lower resistance elements 6 could be twice as long as the upper resistance elements 5. The length of each of the four resistance elements could be increased or decreased based on the needs of the user. Such flexibility to increase or decrease the lengths of the members enables customization of the product to meet the requirements of consumers based on their size and exercise requirement.

Figure 5A:
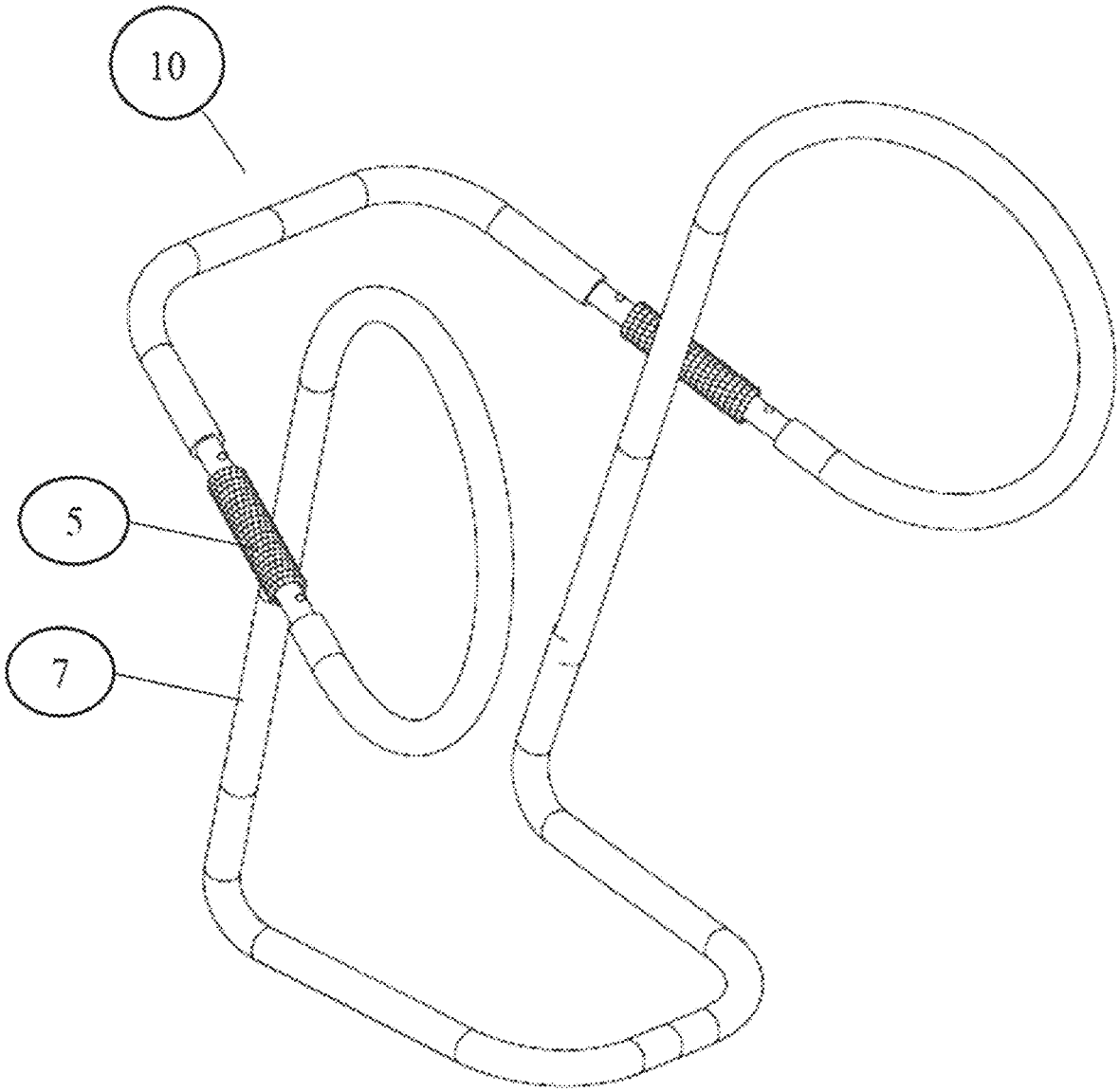
FIG. 5*a* is an isometric view of a continuous loop exercise apparatus 10 showing some of the resistance elements being replaced with solid members, according to another embodiment of the present invention.
Figure 5B:
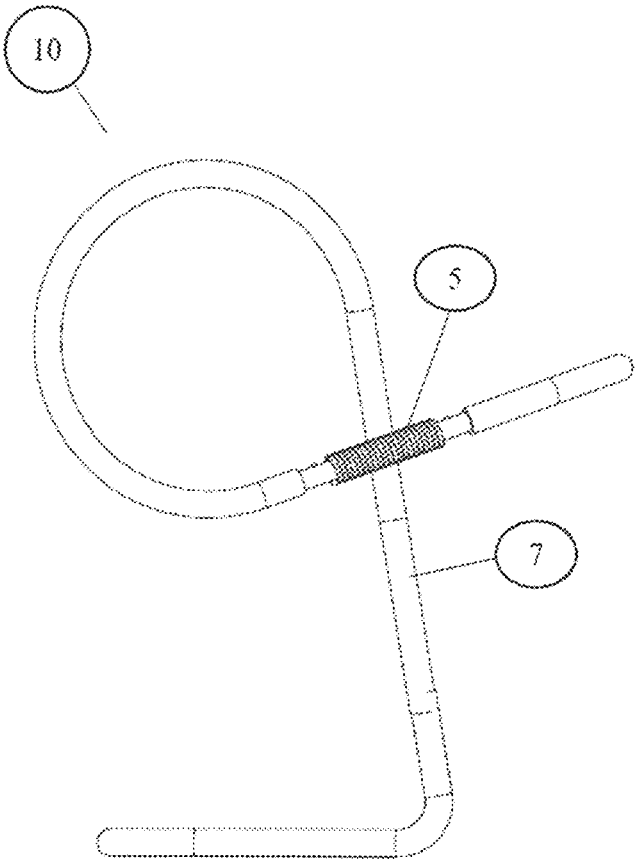
FIG. 5*b* is a side view of a continuous loop exercise apparatus 10 showing some of the resistance elements being replaced with solid members, according to another embodiment of the present invention.

According to yet another embodiment, while the present invention depicts four resistance elements 5, in which a set of two resistance elements 5 could be replaced with stand-alone solid members 7. The potential benefits of substituting the upper or lower resistance elements with solid members include increased stability for particular exercises, and easier to focus on a particular exercise without the incidence of any unanticipated movement. As shown in FIG. 5*a* and FIG. 5*b*, the lower resistance elements 5 are replaced with solid members 7. Alternatively, the upper resistance elements 5 can also be replaced with solid members 7 keeping the lower resistance elements 5 unaltered.

Figure 6A:
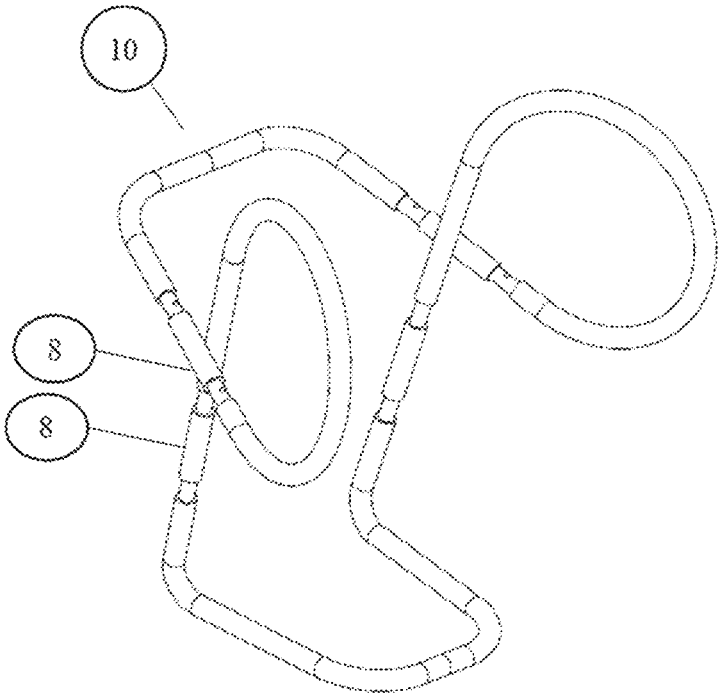
FIG. 6*a* is an isometric view of a continuous loop exercise apparatus 10 showing the resistance elements being replaced with elastic members, according to another embodiment of the present invention.
Figure 6B:
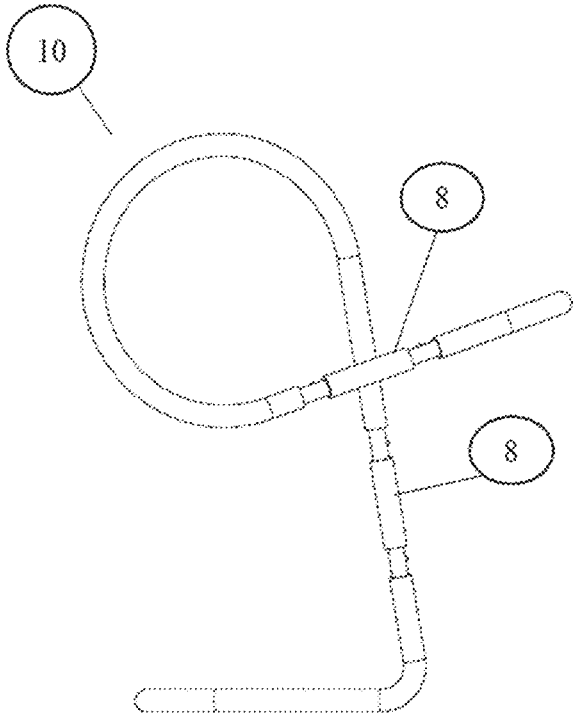
FIG. 6*b* is a side view of a continuous loop exercise apparatus 10 showing the resistance elements being replaced with elastic members, according to another embodiment of the present invention.

According to still another embodiment, the resistance elements 5 may be substituted by elastic members 8 as shown in FIG. 6*a*, and FIG. 6*b*. The elastic members 8 could be but are not limited to springs, bands, cords and thereof. These members provide restorative force during exercise. The elastic members 8 could be constructed from materials including, but not limited to rubber, TPE, and woven fabric (bungie cord). Benefits to this embodiment may include lower manufacturing costs, lower pinch hazard, less shipping weight, and easier assemblage.

According to the present invention, the continuous loop exercise apparatus 10 can be positioned according to the type of exercise that would be performed when the apparatus is placed in a desired position. Some of the positions of the continuous loop exercise apparatus 10 are discussed in detail for reference and are not limited to the embodiments presented herewith.

Figure 7A:
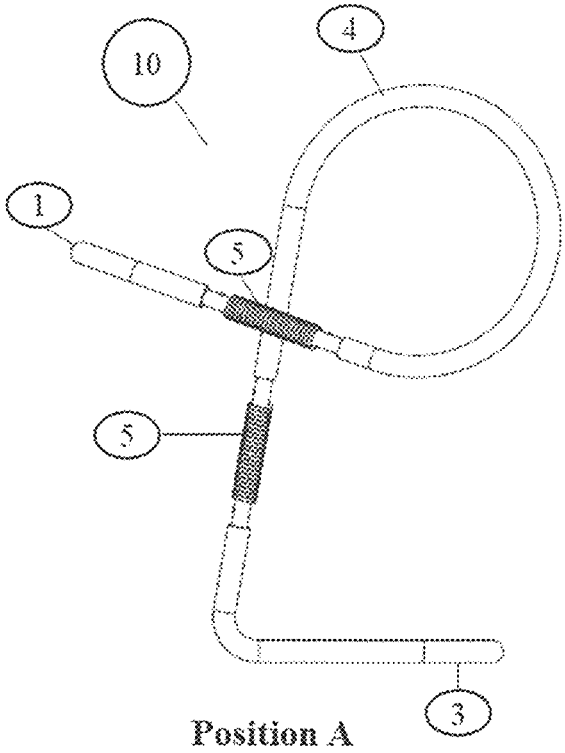
FIG. 7*a* is a side view of a continuous loop exercise apparatus 10 showing the exercise apparatus positioned in position A in accordance with one of the embodiments of the present invention.

According to an embodiment, in a first position, Position A, as shown in FIG. 7*a*, the lower member 3 is placed on the floor or chair, or on a table or a countertop, wherein the loop structures 2 and 4 are positioned closer to the user and the upper member 1 is farther away from the user. In this position, the loop structures 2 and 4 can be flexed inwards or outwards, or pulled downwards or pushed upwards to perform certain types of exercises. Similarly, the upper member 1 can be pushed downwards or pulled upwards.

Figure 7B:
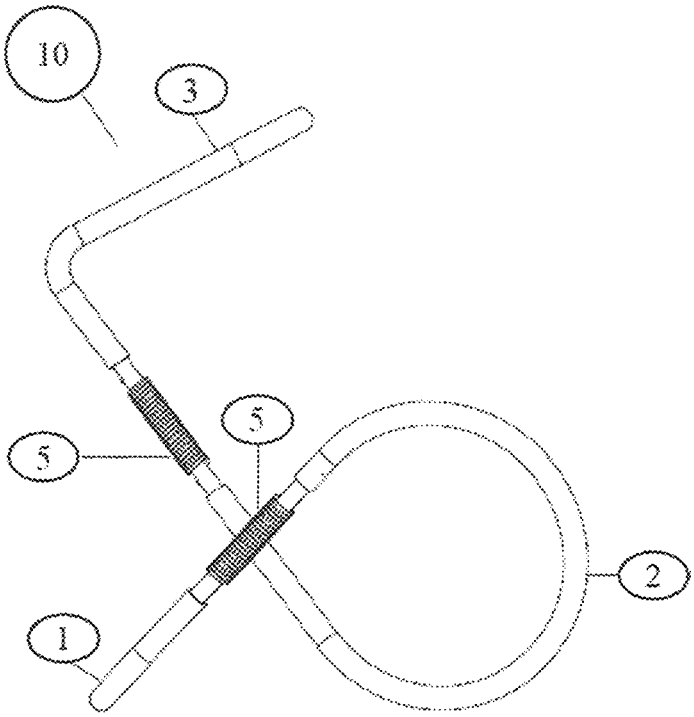
FIG. 7*b* is a side view of a continuous loop exercise apparatus 10 showing the exercise apparatus positioned in position B in accordance with one of the embodiments of the present invention.

According to another embodiment, in another position, Position 5 B, as shown in FIG. 7*b*, the upper member 1 and the loop structures 2 and 4 are placed on the floor or chair or on a table or on a countertop wherein, the lower member 3 is on the top facing upwards. In this position, the lower member 3 can be pulled downwards or pushed upwards to perform certain types of exercises. Similarly, the loop structures 2 and 4 can be flexed inwards and outwards, or pulled upwards or pushed downwards.

Figure 7C:
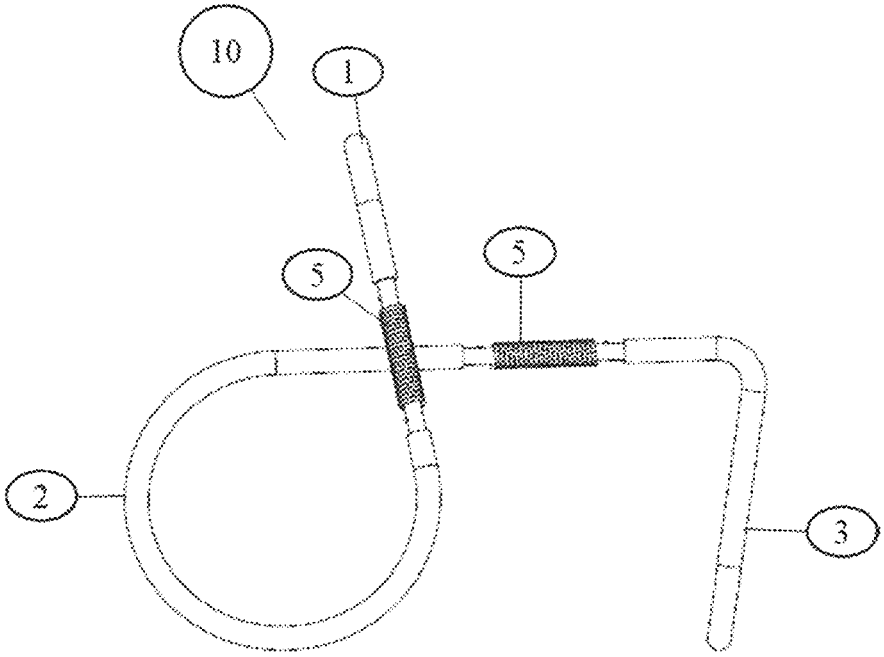
FIG. 7*c* is a side view of a continuous loop exercise apparatus 10 showing the exercise apparatus positioned in position C in accordance with one of the embodiments of the present invention.

According to another embodiment, in yet another position, Position C, as shown in FIG. 7*c*, the lower member 3, and the loop structures 2 and 4 are placed on the floor or chair or on a table or a countertop, wherein the upper member 1 is on the top and facing upwards. In this position, the upper member 1 can be pulled inwards or pushed outwards to perform certain types of exercises. Similarly, the loop structures 2 and 4 can be flexed inward or outward, or pushed upwards or pulled downwards.

Figure 7D:
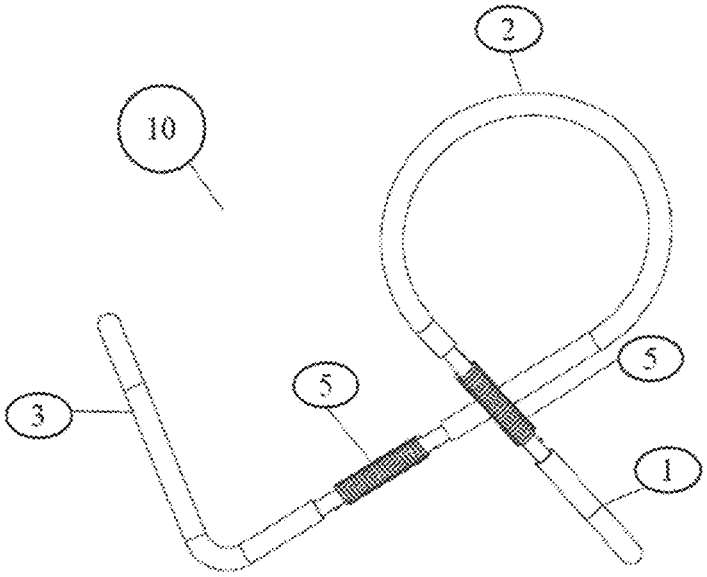
FIG. 7*d* is a side view of a continuous loop exercise apparatus 10 showing the exercise apparatus positioned in position D in accordance with one of the embodiments of the present invention.

According to another embodiment, in still another position, Position D, as shown in FIG. 7*d*, the upper member 1 and the lower member 3 are placed on the floor or chair or on a table or a countertop, wherein the loop structures 2 and 4 are on the top and facing upwards. In this position, the loop structures 2 and 4 can be flexed inwards and outwards, or pulled downwards or pushed upwards to perform certain types of exercises.

Figure 8A:
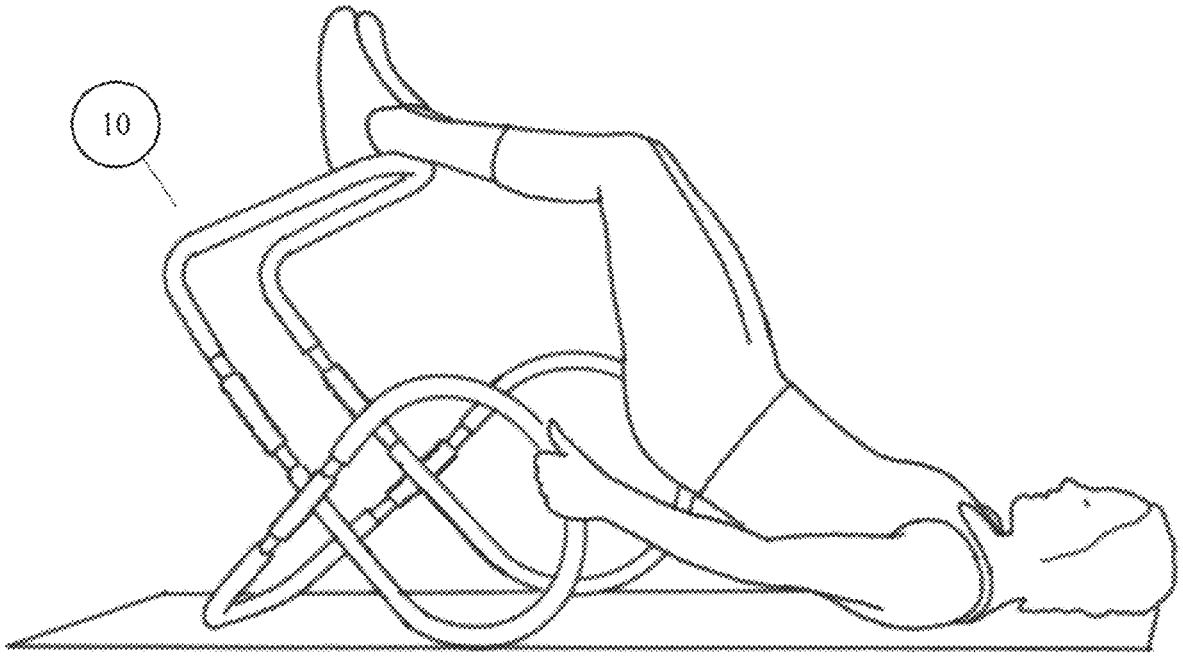
FIG. 8*a* is a side view of an assembled continuous loop exercise apparatus 10 shown as it could be used, in accordance with the present invention.
Figure 8B:
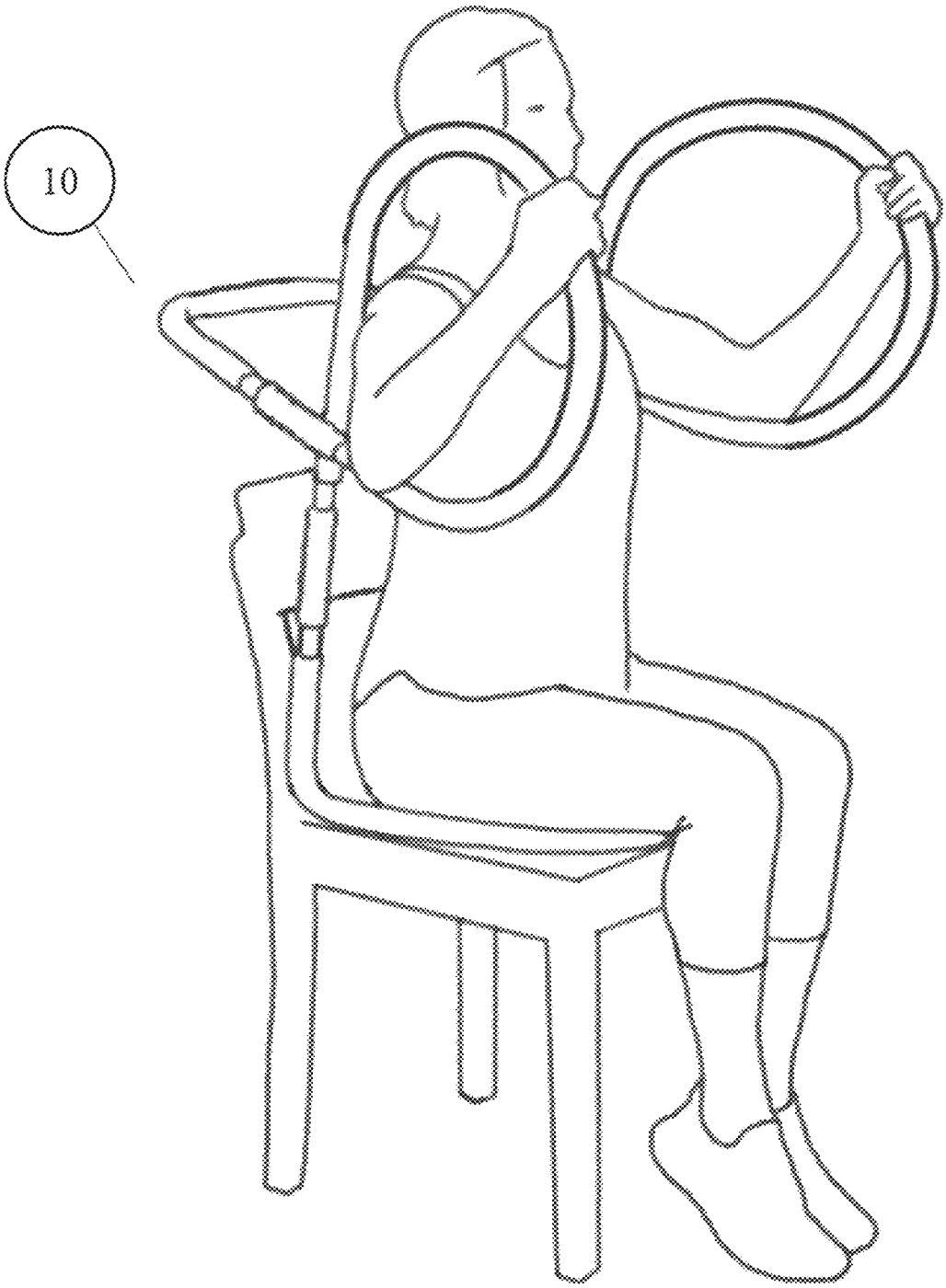
FIG. 8*b* is an isometric view of an assembled continuous loop exercise apparatus 10 shown as it could be used, in accordance with the present invention.
Figure 8C:
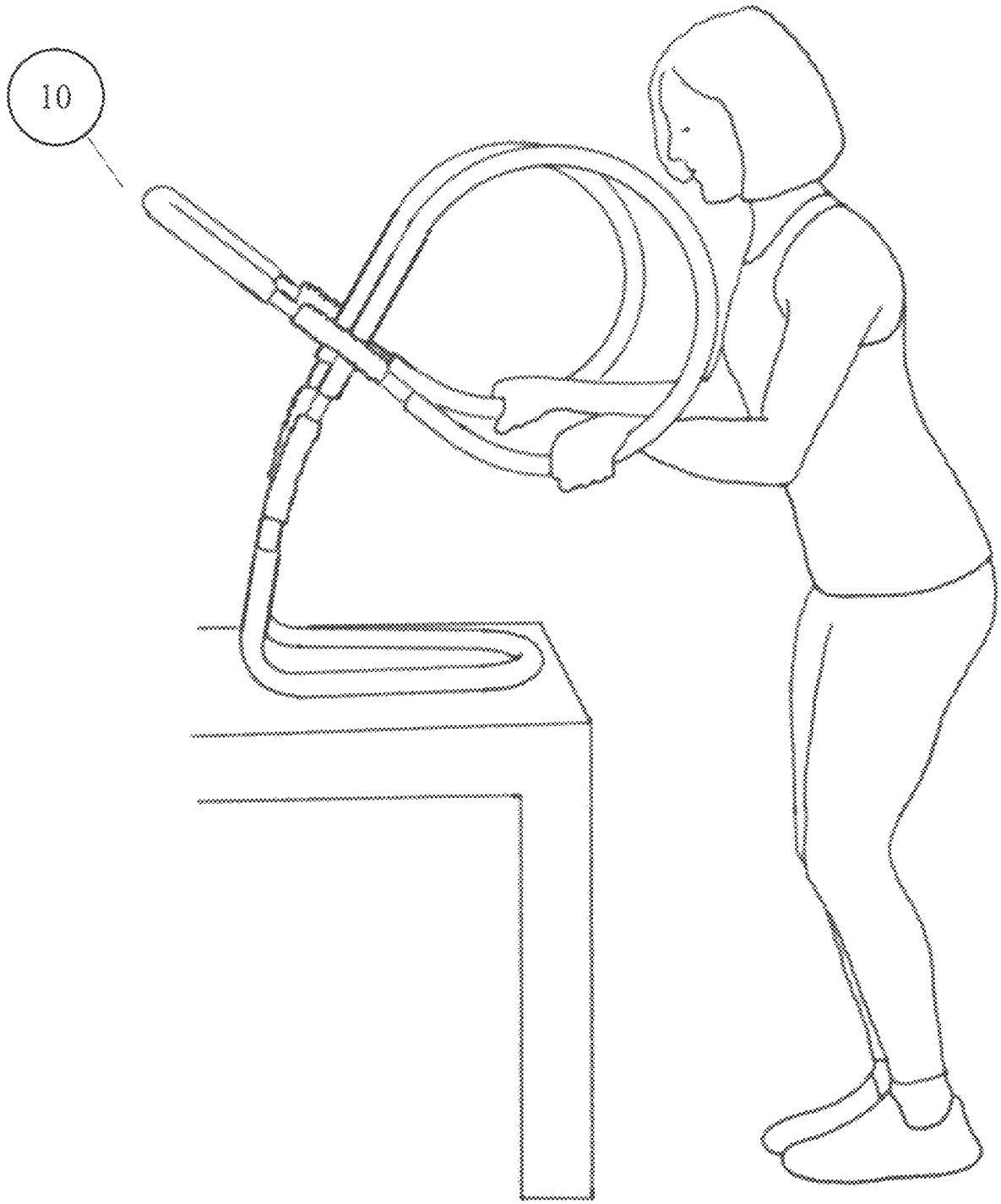
FIG. 8*c* is a side view of an assembled continuous loop exercise apparatus 10 shown as it could be used, in accordance with the present invention.

According to some embodiments of the present invention, as shown in FIG. 8*a*, FIG. 8*b*, and FIG. 8*c*, the continuous loop exercise apparatus 10 can be placed on the floor or a chair or a table or a countertop, however, these figures are for illustration purpose only.

According to some embodiments of the present invention, the members that are resting on the floor or the chair or the table or the countertop, act as supporting structures to allow users to access the members that are not placed on the floor or 10 the chair or the table or the countertop.

According to the embodiments of the present invention, the user can direct force into the members at user selective locations for altering the torque directed into select resistance elements and altering restorative resistance relative to the user.

According to the embodiments of the present invention, the resistance elements could be of varying resistance possessing different resistance characteristics in order to adapt to users need and preferences.

It is to be understood, however, that the present invention would not be limited by any means to the parts, arrangements and materials that are not specifically described, and any change to the materials, variations, sizes and modifications can be made without departing from the spirit and scope described in the present invention.

What is claimed is:

1. A continuous loop exercise apparatus comprising:

a) an upper support member, wherein the upper support member comprises a first upper support member end and a second upper support member end, and each of the first upper support member end and the second upper support member end comprises an upper support member mateable connection, the upper support member providing an upper support for a user to hold;

b) a right loop member, wherein the right loop member comprises a first right loop member end and a second right loop member end, and each of the first right loop member end and the second right loop member end comprises a right loop member mateable connection, the right loop member providing a first loop structure for the user to hold;

c) a lower support member, wherein the lower support member comprises a first lower support member end and a second lower support member end, and each of the first lower support member end and the second lower support member end comprises a lower support member mateable connection, the lower support member providing a lower support structure for resting the continuous loop exercise apparatus upon a support surface in a first exercise position;

d) a left loop member, wherein the left loop member comprises a first left loop member end and a second left loop member end, and each of the first left loop member end and the second left loop member end comprises a left loop member mateable connection, the left loop member providing a second loop structure for the user to hold; and e) a plurality of resistance elements, wherein the plurality of resistance elements comprises a first resistance element end and a second resistance element end, and each of the first resistance element end and the second resistance element end comprises a resistance element mateable connection;

f) the upper support member being connectable to the right loop member and the left loop member via a first set of resistance elements, the first right loop member end, and the first left loop member end; and g) the lower support member being connectable to the right loop member and the left loop member via a second set of resistance elements, the second right loop member end, and the second left loop member end.

2. The continuous loop exercise apparatus according to claim 1, wherein the resistance elements comprise springs, elastic members, and bands.

3. The continuous loop exercise apparatus according to claim 1, wherein the resistance elements are configured to be interchangeable with other resistance elements comprising differing restorative force characteristics.

4. The continuous loop exercise apparatus according to claim 1, wherein the resistance elements are configured to be interchangeable with solid members.

5. The continuous loop exercise apparatus according to claim 1, wherein the resistance elements are in-line with solid members eliminating any protruding elements.

6. The continuous loop exercise apparatus according to claim 1, wherein the first right loop member end and the first left loop member end respectively extend inwardly of the second right loop member end and the second left loop member end.

7. The continuous loop exercise apparatus according to claim 1, wherein the continuous loop exercise apparatus is configured to be positioned in a select exercise position for user exercise, the select exercise position being selected from the first exercise position, a second exercise position, a third exercise position, and a fourth exercise position.

8. The continuous loop exercise apparatus according to claim 1, whereby the continuous loop exercise apparatus is configured to enable resistive training by enabling the user to position the continuous loop exercise apparatus in a plurality of positions such that the user can apply force on the right member, the left member, the upper member or the lower member which can be flexed inward, outward, upward, or downward to perform various exercises.

9. The continuous loop exercise apparatus according to claim 8, whereby the continuous loop exercise apparatus is configured such that the user is able to direct force into the upper, lower, right, and left members at user selective locations for (a) altering torque directed into select resistance elements, and (b) altering restorative resistance relative to the user.

10. A continuous loop exercise apparatus comprising:

a. an upper support member, wherein the upper support member comprises a first upper support member end and a second upper support member end, and each of the first upper support member end and the second upper support member end comprises an upper support member mateable connection, the upper support member providing an upper support for a user to hold;

b. a right loop member, wherein the right loop member comprises a first right loop member end and a second right loop member end, and each of the first right loop member end and the second right loop member end comprises a right loop member mateable connection, the right loop member providing a first loop structure for the user to hold;

c. a lower support member, wherein the lower support member comprises a first lower support member end and a second lower support member end, and each of the first lower support member end and the second lower support member end comprises a lower support member mateable connection, the lower support member providing a lower support structure for resting the continuous loop exercise apparatus upon a support surface in a first exercise position;

d. a left loop member, wherein the left loop member comprises a first left loop member end and a second left loop member end, and each of the first left loop member end and the second left loop member end comprises a left loop member mateable connection, the left loop member providing a second loop structure for the user to hold; and e. a plurality of resistance elements, wherein the plurality of resistance elements comprises a first resistance element end and a second resistance element end, and each of the first resistance element end and the second resistance element end comprises a resistance element mateable connection;

f. wherein the upper support member comprises an upper support member U-shape in first and second dimensions and the lower support member comprises a lower support member U-shape in first and second dimensions, the first lower member end and the second lower member end each extending in a third dimension relative to the lower support member U-shape, the lower support member being L-shaped and the upper support member being linear when the continuous loop exercise apparatus is viewed from the side.

11. The continuous loop exercise apparatus according to claim 10, wherein the upper support member U-shape extends in a first direction and the lower support member U-shape extends in a second direction, the second direction being opposed to the first direction.

12. The continuous loop exercise apparatus according to claim 10, wherein the upper support member U-shape extends in an upper support member plane and the lower support member U-shape extends in a lower support member plane, the right loop member and the left loop member extending such that the upper support member plane extends intermediate the right and left loop members and the lower support member plane.

13. The continuous loop exercise apparatus according to claim 12, wherein the continuous loop exercise apparatus is configured for exercise movement comprising:

(a) movement of the upper support member plane via manual force directed into the upper support member;

(b) movement of the lower support member plane via manual force directed into the lower support member;

(c) movement of the right loop member and the left loop member relative to the lower support member plane via manual force directed into the right loop member and the left loop member; and (d) movement of the right loop member and the left loop member relative to one another.

14. The continuous loop exercise apparatus according to claim 10, wherein the continuous loop exercise apparatus is configured to be positioned in a select exercise position for user exercise, the select exercise position being selected from the first exercise position, a second exercise position, a third exercise position, and a fourth exercise position.

15. The continuous loop exercise apparatus according to claim 14, wherein:

(a) the first exercise position is characterized by placement of the lower support member U-shape upon the support surface;

(b) the second exercise position is characterized by placement of the upper support member, the right loop member, and the left loop member upon the support surface;

(c) the third exercise position is characterized by placement of the lower support member, the right loop member, and the left loop member upon the support surface, and (d) the fourth exercise position is characterized by placement of the upper support member and the lower support member upon the support surface.

16. The continuous loop exercise apparatus according to claim 10 whereby the continuous loop exercise apparatus is configured to enable resistive training by enabling the user to position the continuous loop exercise apparatus in a plurality of positions such that the user can apply force on the right member, the left member, the upper member or the lower member which can be flexed inward, outward, upward, or downward to perform various exercises.

17. The continuous loop exercise apparatus according to claim 16, whereby the continuous loop exercise apparatus is configured such that the user is able to direct force into the upper, lower, right, and left members at user selective locations for (a) altering torque directed into select resistance elements, and (b) altering restorative resistance relative to the user.

* * * * *